US006981630B2

(12) United States Patent
Popovich et al.

(10) Patent No.: US 6,981,630 B2
(45) Date of Patent: Jan. 3, 2006

(54) CARTRIDGE STRIP ADVANCING MECHANISM FOR FASTENER DRIVING TOOL

(75) Inventors: Michael S. Popovich, Bartlett, IL (US); Edward D. Yates, Chicago, IL (US); Robert Urquhart Connell, Hawthorn (AU); David John McCullough, Hawthorn East (AU)

(73) Assignee: Illinois Tool Works Inc., Glenview, IL (US)

( * ) Notice: Subject to any disclaimer, the term of this patent is extended or adjusted under 35 U.S.C. 154(b) by 118 days.

(21) Appl. No.: 10/653,038

(22) Filed: Aug. 29, 2003

(65) Prior Publication Data

US 2005/0035172 A1 Feb. 17, 2005

Related U.S. Application Data

(63) Continuation of application No. 10/246,261, filed on Sep. 18, 2002, now abandoned, which is a continuation-in-part of application No. 09/689,095, filed on Oct. 12, 2000, now Pat. No. 6,547,120.

(51) Int. Cl.
*B25C 1/14* (2006.01)

(52) U.S. Cl. ..... 229/9; 227/10

(58) Field of Classification Search ..... 227/8, 227/9, 10, 119, 18, 130; 123/46 SC
See application file for complete search history.

(56) References Cited

U.S. PATENT DOCUMENTS

| | | | | |
|---|---|---|---|---|
| 329,366 A | | 10/1885 | Crisp | |
| 3,067,454 A | | 12/1962 | Catlin et al. | |
| 3,554,425 A | | 1/1971 | Oesterle | |
| 3,565,313 A | * | 2/1971 | Seghezzi et al. | 227/10 |
| 3,609,901 A | | 10/1971 | Necas | |
| 3,891,133 A | | 6/1975 | Maier et al. | |
| 4,074,843 A | * | 2/1978 | Oesterle | 227/8 |
| 4,077,556 A | * | 3/1978 | Buchel | 227/8 |
| 4,200,216 A | | 4/1980 | Maier | |
| 4,267,952 A | * | 5/1981 | Kershner | 227/9 |
| 4,375,269 A | | 3/1983 | Bosch et al. | |
| 4,804,127 A | | 2/1989 | Kirkman | |
| 5,135,151 A | * | 8/1992 | Logan | 227/9 |
| 5,299,373 A | | 4/1994 | Breiner | |
| 5,363,736 A | | 11/1994 | Huang | |
| 5,425,488 A | | 6/1995 | Thompson | |
| 5,429,291 A | | 7/1995 | Thompson | |
| 5,465,893 A | | 11/1995 | Thompson | |

(Continued)

FOREIGN PATENT DOCUMENTS

DE 20 44 920 A 3/1972

(Continued)

*Primary Examiner*—Scott A. Smith
(74) *Attorney, Agent, or Firm*—Lisa M. Soltis; Mark W. Croll; Beem Patent Law Firm

(57) ABSTRACT

In a powder driven fastening tool, a channel is included for feeding a strip of explosive powder cartridges to a firing mechanism. A trigger is included for actuating the firing mechanism, wherein the trigger is movable between a first position and a second position. An advancing lever is pivotally coupled to the tool, the advancing lever having a strip engagement portion for indexing the strip which extends into the channel. An advance link is cammingly engaged with the advancing lever and is operationally associated with the trigger so that the strip engagement portion is in a first position in the channel when the trigger is in the first position and so the strip engagement portion is in a second position when the trigger is in the second position.

14 Claims, 11 Drawing Sheets

U.S. PATENT DOCUMENTS

| | | | |
|---|---|---|---|
| 5,518,161 | A | 5/1996 | Thompson |
| 5,934,162 | A | 8/1999 | Habermehl |
| 5,992,723 | A | 11/1999 | Lee |
| 6,059,162 | A | 5/2000 | Popovich et al. |
| 6,126,055 | A | 10/2000 | Gantner et al. |
| 6,272,782 | B1 | 8/2001 | Dittrich et al. |
| 6,343,535 | B1 | 2/2002 | Gaudron |
| 6,378,752 | B1 | 4/2002 | Gaudron |
| 6,547,120 | B1 * | 4/2003 | Popovich et al. ..... 227/10 |

FOREIGN PATENT DOCUMENTS

| | | | |
|---|---|---|---|
| EP | 1 197 301 | A2 | 4/2002 |
| FR | 1 206 716 | A | 2/1960 |
| WO | WO-00/35638 | A1 | 6/2000 |

* cited by examiner

CARTRIDGE STRIP ADVANCING MECHANISM FOR FASTENER DRIVING TOOL

This application is a Continuation of U.S. application Ser. No. 10/246,261, filed on Sep. 18, 2002, now abandoned which is a Continuation-In-Part of U.S. application Ser. No. 09/689,095, filed on Oct. 12, 2000, now U.S. Pat. No. 6,547,120 and this application claims priority to the Australian Provisional Application 2002951660, filed on Sep. 25, 2002 in the Australian Patent Office.

BACKGROUND OF THE INVENTION

1. Field of the Invention

The present invention is directed to powder actuated tools, and more particularly to a powder actuated fastener driving tool having automatic powder cartridge strip indexing.

2. Description of the Related Art

Powder actuated fastener setting tools are known generally. U.S. Pat. No. 5,429,291 entitled "Compression Actuated Tool For Driving Fasteners" assigned commonly with the present application, for example, discloses a powder driven tool including a manually operated spring biased indexing lever pivotally mounted thereon for advancing a magazine strip retaining a plurality of powder cartridges therein through a magazine channel of the tool.

For many powder actuated tools it is desirable to have a mechanism that indexes a strip of explosive powder cartridges after the tool has been fired so that a fresh cartridge is ready for firing without the operator having to do anything. An example of an indexing mechanism is disclosed in the commonly assigned patent application having the Ser. No. 09/689,095 entitled "Powder Driven Fastener Setting Tool," the disclosure of which is incorporated herein by reference. The above referenced application teaches the use of a reciprocating sleeve which drives an indexing lever to index a strip of cartridges along a magazine channel. The sleeve reciprocates during firing of the tool, and is returned when an operator pushes the sleeve into its original position.

In some applications it may be desirable to make the indexing of the cartridge strip automatic, so that the operator does not have to perform the added step of pushing the reciprocating sleeve back into its original, pre-firing position. However, the indexing of the cartridge strip still must be driven by the motion of some part of the fastener driving tool. One possible part to use to drive the indexing of the cartridge strip is to use the motion of a trigger, wherein the trigger also actuates a firing mechanism of the tool. U.S. Pat. No. 6,272,782 to Dittrich et al. discloses a cartridge advancing mechanism linked to the trigger using connected pivoting levers.

A problem that has occurred with tools using pivoting levers has been "dead stop" of the trigger. When the trigger and advancing mechanism are directly linked, such as with connected pivoting levers, the trigger can come to a hard, or dead, stop when the advancing mechanism comes to a stop as it engages with the cartridge strip. Dead stopping can become uncomfortable for an operator due to repetitive use of the tool.

Another problem that has been common with advancing mechanism for explosive powder actuated tools is complexity requiring a large number of interconnected parts and moving parts to ensure operation of the advancing mechanism.

What is needed is a fastener driving tool which uses the motion of the trigger to drive an automatic indexing of a strip of explosive cartridges, while requiring fewer parts and overcoming the dead stop phenomenon of the prior art.

BRIEF SUMMARY OF THE INVENTION

In accordance with the present invention, a powder driven fastening tool is provided with a novel and inventive cartridge strip advancing mechanism. The fastening tool comprises a magazine channel for feeding a strip of cartridges to a firing mechanism, a trigger for actuating the firing mechanism, the trigger being movable between a first position and a second position, an advancing lever pivotally coupled to the tool, the advancing lever having a strip engagement portion extending into the magazine channel for indexing the strip, an advance link cammingly engaged with the advancing lever and operationally associated with the trigger, the magazine engagement portion being in a first position in the magazine channel when the trigger is in the first position, and the magazine strip engagement portion being in a second position in the magazine channel when the trigger is in the second position.

These and other objects, features and advantages are evident from the following description of an embodiment of the present invention, with reference to the accompanying drawings.

DETAILED DESCRIPTION OF THE INVENTION

Generally, a magazine strip or some other member is incrementally indexed through a channel of a fastening tool by an indexing lever actuated by a lever cam that moves between first and second positions with some other portion of the tool.

Figure 1:
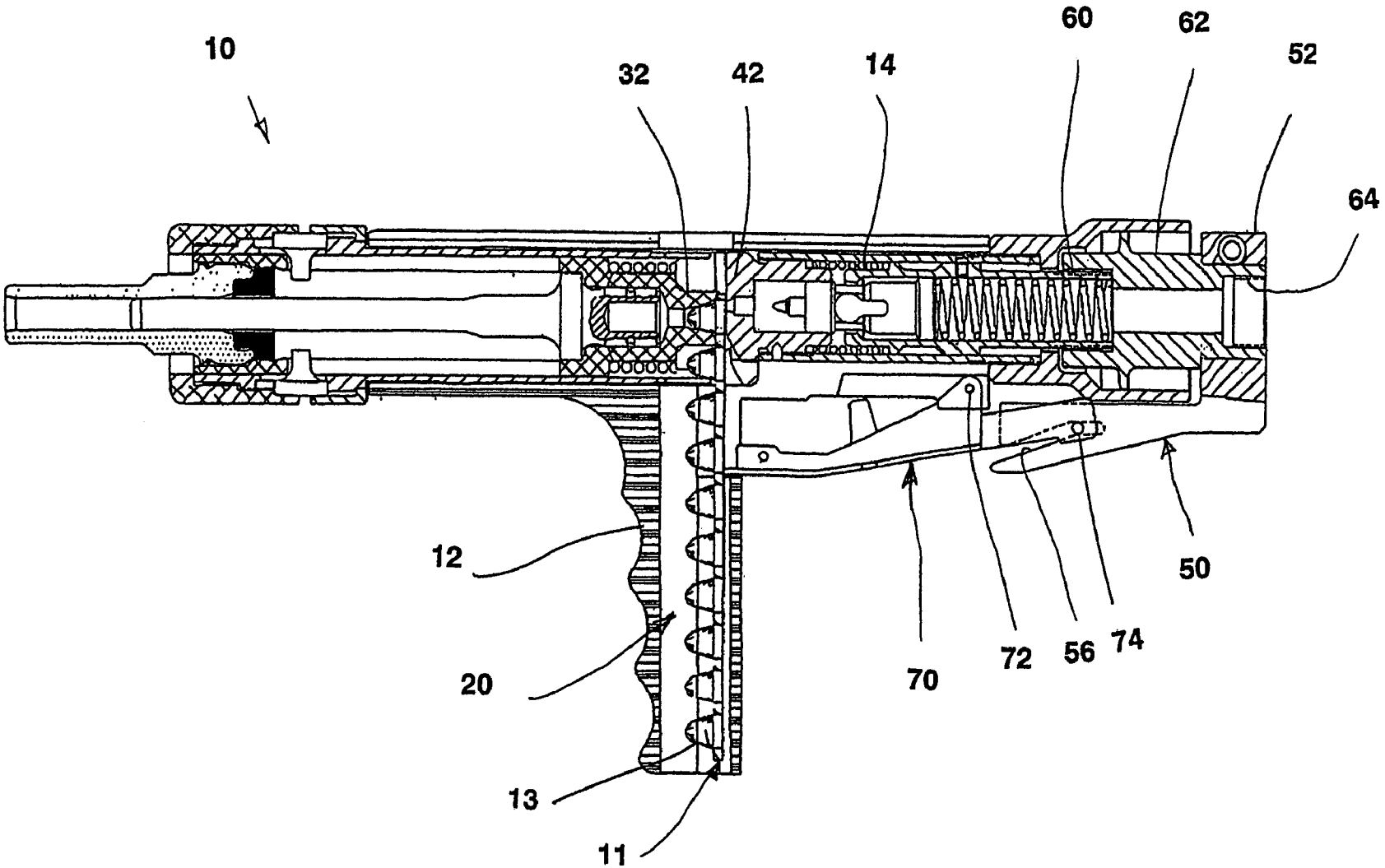
FIG. 1 is a partial sectional view of an exemplary powder actuated tool in a first configuration.

In the exemplary powder driven fastener setting tool 10 of FIG. 1, a magazine strip 11 is fed or indexed along a magazine channel 20 disposed in a pistol-type grip 12 of the tool. The magazine channel 20 extends to and through a firing chamber disposed between a barrel breech end 32 and a breech block 42 of the tool.

The magazine strip 11 retains a plurality of spaced apart explosive cartridges 13 that are sequentially positioned in alignment with a cartridge recess in the breech end of the barrel, for accommodation therein during detonation, as the magazine strip is indexed through the magazine channel.

In other embodiments, the magazine channel may be configured differently, and more generally it may be any passage, or channel, in the tool through which it is desirable to move, or index, a magazine strip or some other member.

In FIG. 1, a lever cam 50 is coupled to a compression triggering mechanism of the tool 10, and more particularly to a spring biased sleeve 60 that reciprocates between first and second positions during operation of the tool.

The firing mechanism sleeve is aligned substantially axially with the barrel of the tool and reciprocates along its axis upon compression thereof against the spring bias.

Figure 2:
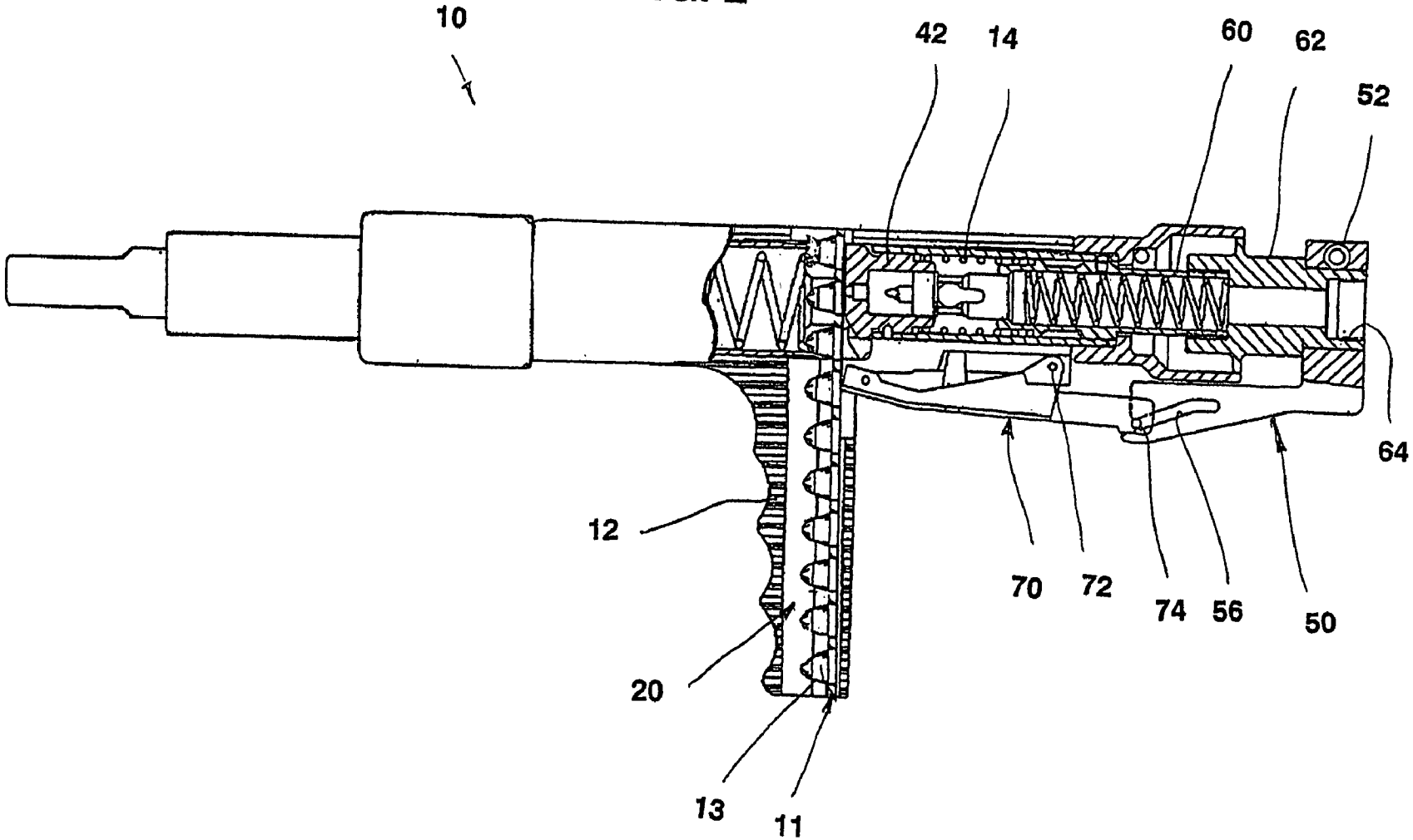
FIG. 2 is a partial sectional view of the exemplary powder actuated tool in a second configuration.

Particularly, in FIG. 2, a spring 14 disposed between the breech block 42 and the sleeve 60 biases the sleeve to the first position when the spring is relatively expanded. The sleeve is movable to the second position against the spring bias, as illustrated in FIG. 1, upon application of an axial compression force thereto as is known generally by those having ordinary skill in the art.

Alternative exemplary compression triggering mechanisms in powder driven fastener setting tools are known generally and the operation thereof is disclosed more fully, for example, in the referenced U.S. Pat. No. 5,429,291 entitled "Compression Actuated Tool For Driving Fasteners", the disclosure of which is incorporated herein by reference.

In FIGS. 1 and 2, the lever cam 50 extends from an integral flange 52 that is coupled, for example by screw thread or other engagement, to the sleeve 60 and particularly to a handle portion 62 thereof. The exemplary handle portion 62 is assembled with the sleeve 60 and abuts a firing pin actuating spring within the sleeve.

The exemplary handle portion 62 includes an optional pole connector 64, to which may be coupled, for example by screw thread or other engagement, an extension pole.

Alternatively, the handle portion 62 may be formed integrally with the sleeve 60, or the handle portion 62 may be formed integrally with the flange 52 and the lever cam 50.

In other embodiments, the handle portion 62 and flange 52 may not be required, for example in embodiments that do not include a firing pin actuating spring. In this embodiment, the lever cam 50 is an integral part of or is coupled directly to the sleeve or to some other member coupled thereto extending axially from the rear end portion of the tool.

In still other alternative embodiments, the lever cam 50 may be coupled to some other reciprocating portion of the tool, for example to the barrel thereof.

The tool also comprises an indexing lever 70 pivotally coupled thereto, for example by a pivot pin 72 or some other pivoting member or members. The indexing lever generally comprises a magazine engagement portion and a cam follower portion disposed on generally opposite sides of the pivot pin in the exemplary embodiment.

The cam follower portion of the indexing lever is cammingly engaged with the lever cam as the lever cam moves between first and second positions in unison with the reciprocating portion of the tool to which it is coupled, thereby pivoting the indexing lever.

In FIGS. 1 and 2, the lever cam 50 includes a ramped cam slot 56, and the cam follower portion of the indexing lever 70 includes a lever pin 74 that is disposed in and follows the ramped cam slot 56 as the lever cam 50 moves with the sleeve between the first and second positions. Particularly, the lever pin 74 moves between first and second positions along the ramped cam slot 56 as the lever cam 50 moves between its first and second positions in unison with the reciprocating portion of the tool to which it is coupled.

Generally, the magazine engagement portion of the indexing lever extends into the magazine channel where it engages and indexes the magazine strip during movement of the indexing lever toward the firing chamber.

Figure 3:
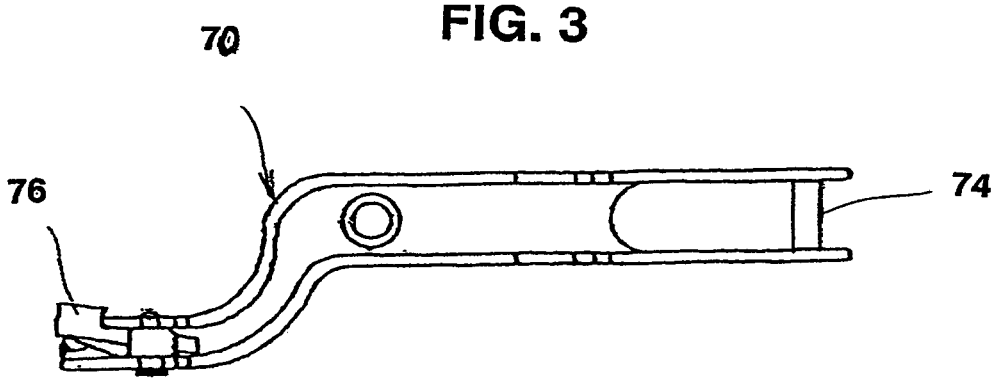
FIG. 3 is a top view of an exemplary magazine strip indexing lever.

FIG. 3 illustrates the exemplary indexing lever 70 having a known ratcheting magazine engagement portion with a spring biased tooth 76 for engaging the magazine strip. In other embodiments, however, other magazine engagement configurations may be employed.

The reciprocating action of the lever cam 50 pivots the indexing lever 70 back and forth to locate the magazine engagement portion thereof between first and second positions in the magazine channel of the tool, alternately toward and away from the firing chamber.

In FIG. 2, when the sleeve 60 is extended by the spring 14, the magazine strip engagement portion of the indexing lever is positioned toward the firing chamber. And in FIG. 1, when the sleeve is depressed or compressed against the bias of the spring 14, the magazine strip engagement portion is positioned away from the firing chamber.

Figure 4:
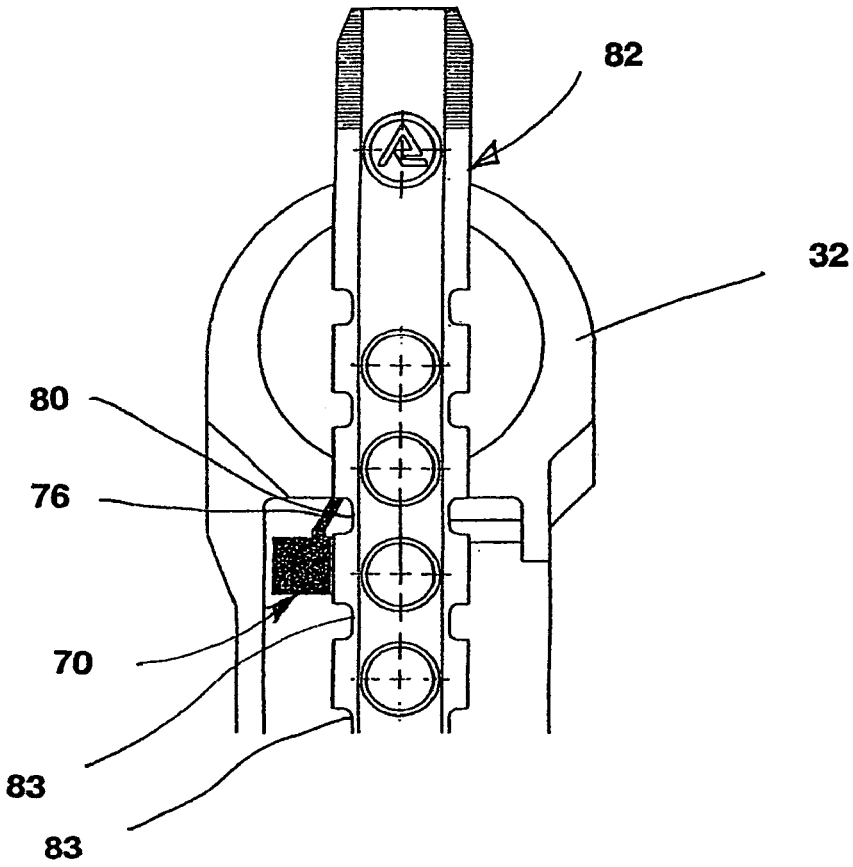
FIG. 4 is a partial sectional view of the magazine strip indexing lever engaged with a magazine strip.

FIG. 4 illustrates the magazine engagement portion of the indexing lever and particularly the ratcheting tooth 76 thereof engaged with spaced apart notches 80 disposed along a side of the magazine strip 82.

The magazine strip is indexed upwardly in FIG. 4 as the indexing lever 70 moves from the position away from the firing chamber, illustrated in FIG. 1, to the position toward the firing chamber illustrated in FIG. 2. During this upward motion of the magazine engagement portion of the indexing lever, the tooth 76 thereof is spring biased into a notch of the magazine strip, notch 80 in FIG. 4, whereby the magazine strip is indexed upwardly.

As the magazine engagement portion of the indexing lever moves away from the firing chamber, from the position illustrated in FIG. 2 to the position illustrated in FIG. 1, the tooth 76 is withdrawn against its spring bias from the notch without moving the magazine strip downwardly. In FIG. 4, as the magazine engagement portion of the indexing lever moves downwardly, the magazine engagement portion is withdrawn from the notch 80 and is moved to a lower position, where it engages a lower notch 83 on the magazine strip 82.

The incremental indexing of the magazine strip thus proceeds with the reciprocation of the firing mechanism or other moving portion of the tool to which the indexing lever is coupled.

In the above-mentioned embodiment, the reciprocating motion of sleeve 60 is used as the driving motion behind the indexing of cartridge strip 82. As described above, this embodiment requires an operator to push sleeve 60 back into position to return indexing lever 70 into its original, pre-firing position shown in FIG. 1. It is preferred that tool 10 be designed so that all parts of tool 10 return to their pre-firing position automatically, including indexing lever 70.

Figure 5:
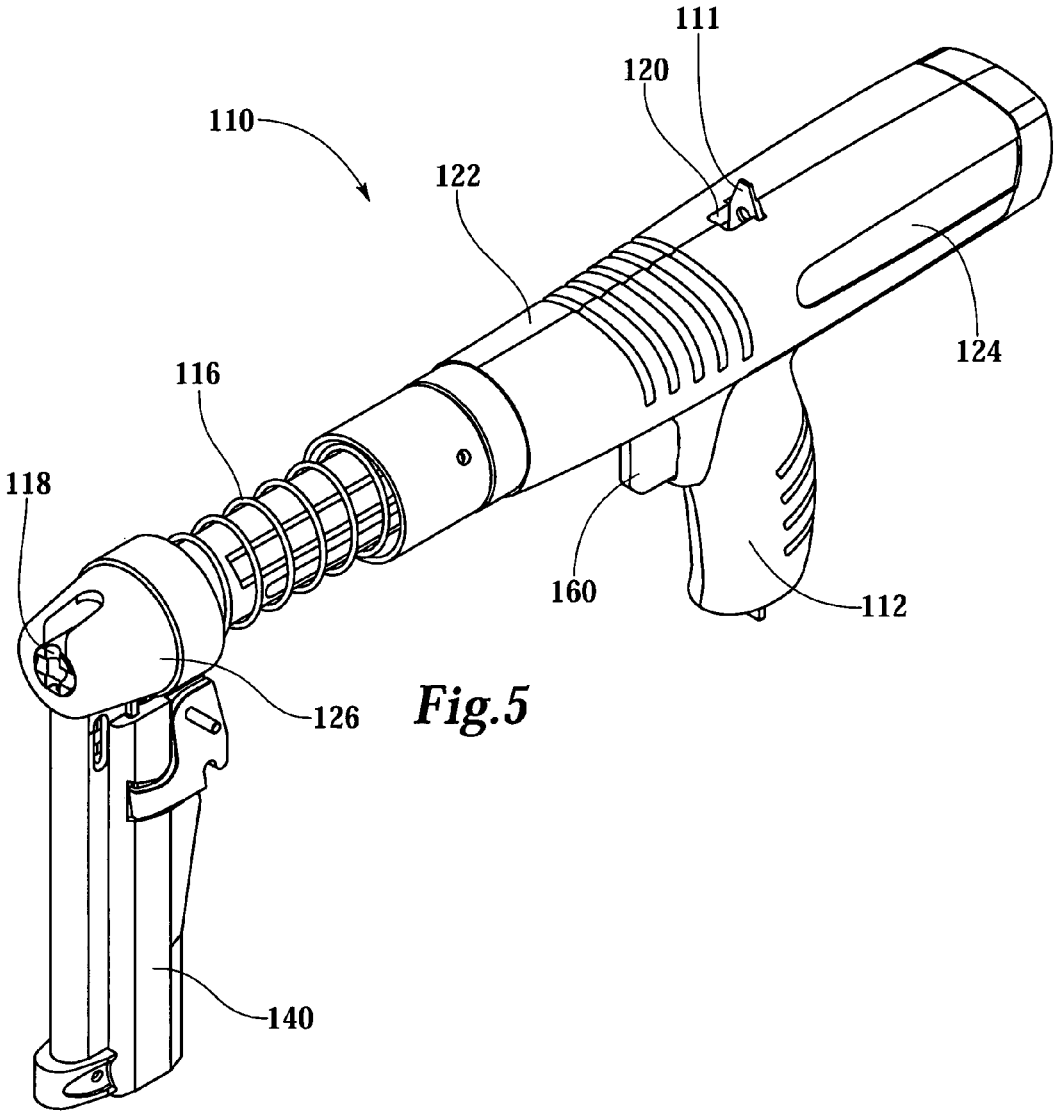
FIG. 5 is a perspective view of an alternative powder actuated tool.

Turning to FIG. 5, an embodiment of a fastener driving tool 110 includes a spring 116 to bias a muzzle 118 into an extended pre-firing position with respect to a housing 122 of tool 110. Tool 110 includes a back end 124 and a front end 126.

Figure 7:
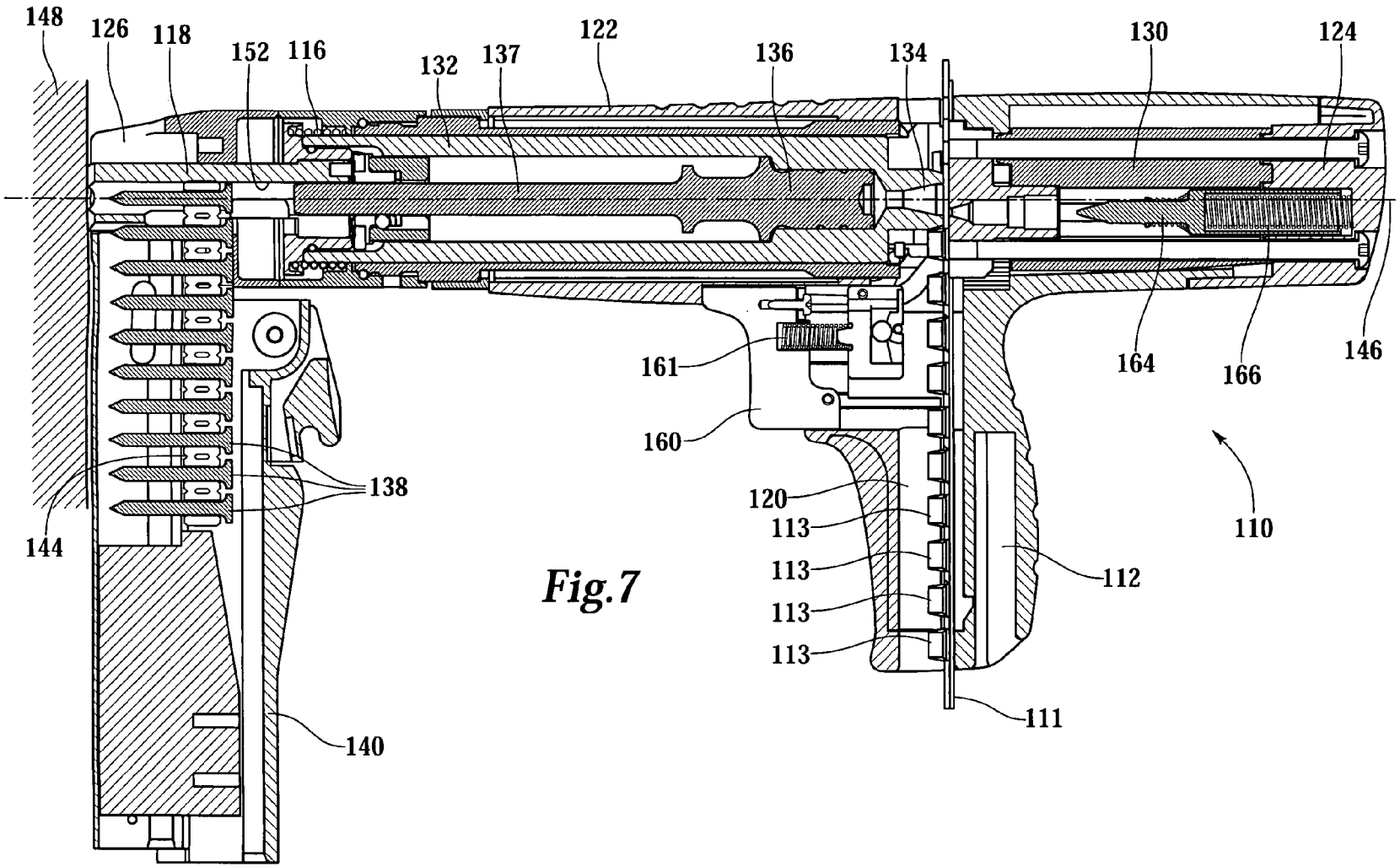
FIG. 7 is as side sectional view of the powder actuated tool.

Turning to FIG. 7, a firing mechanism 130 is contained within back end 124 of housing 122 for firing explosive cartridges 113 in a firing chamber 134 to drive a piston 136 in the driving direction to drive fasteners 138. The front end 126 includes muzzle 118, a magazine 140 for feeding a collation strip 144 of fasteners 138 to muzzle 118, and a clutch (not shown) for rotating muzzle 118 and magazine 140 with respect to housing 122, allowing magazine 140 to be set in various orientations.

Examples of a preferred magazine and a preferred clutch are disclosed in the commonly assigned patent applications entitled "Magazine Assembly With Stabilizing Members," having U.S. application Ser. No. 10/246,186, "Lock Out Mechanism For Powder Actuated Tool," having U.S. application Ser. No. 10/245,942, and "Magazine Clutch Assembly," having U.S. application Ser. No. 10/246,203, all filed on Sep. 18, 2002, the disclosures of which are incorporated herein by reference.

Continuing with FIG. 7, tool 110 includes a barrel 132 enclosed within housing 122, and a muzzle 118 extending axially away from housing 122. Housing 122, barrel 132 and muzzle 118 are all generally cylindrical in shape having a common central axis 146 extending throughout the length of tool 110. Barrel 132 encloses piston 136 which drives fasteners 138 into a substrate 148, wherein piston 136 is also generally cylindrical in shape and is aligned coaxially with barrel 132 and muzzle 118. Muzzle 118 includes a bore 152 for axially guiding a driving 137 of piston 136 and fasteners 138 toward substrate 148.

Housing 122 includes a handle 112 laterally extending away from axis 146. Handle 112 provides a location for an operator to hold when actuating tool 110. A trigger 160 is connected to handle 112 for actuating firing mechanism 130 and firing tool 110.

FIG. 7 shows tool 110 driving fasteners 138 generally from the right to the left. However, tool 110 can be operated in several different orientations, such as to drive fasteners 138 into a vertically aligned substrate 148 so that fasteners 138 are driven horizontally from left to right, or tool 110 can be operated so that fasteners 138 are driven vertically upward or downward into substrate 148. Therefore, for the purpose of discussion, any reference to the direction in which a fastener 138 is driven, such as toward the left in FIG. 7, is generally referred to as the driving direction or leading direction and any reference to the opposite direction, toward the right in FIG. 7, is generally referred to as the trailing direction.

FIG. 7 also show a cartridge strip 111 being indexed generally upward. However, as described above, tool 110 can be operated in several different orientations. Therefore, the direction in which cartridge strip 111 is indexed, such as upwardly in FIG. 7, is generally referred to as the indexing direction. For purposes of discussion, upwardly and above will refer generally to the indexing direction and downwardly and below will refer generally to a direction opposite the indexing direction.

Muzzle 118 is pushed against substrate 148 when tool 110 is to be used to drive a fastener 138 into substrate 148. Pushing against substrate 148 overcomes the biasing force of spring 116, so that muzzle 118 is forced in the trailing direction with respect to housing 122 into a retracted ready-to-fire position. Muzzle 118 is aligned coaxially with barrel 132 and is adjacent to barrel 132 in the driving direction. When muzzle 118 is pushed in the trailing direction by substrate 148, muzzle 118 engages barrel 132 and biases barrel in the trailing direction as well. As barrel 132 is pushed in the trailing direction, it engages a cocking rod 162, shown in FIG. 6, which enables a firing mechanism 130, allowing tool 110 to be fired. The mechanism described above requires that an operator push muzzle 118 into the retracted position relative to housing 122 before tool 110 can be fired so that tool 110 cannot be actuated unless muzzle 118 is pushed into the retracted position.

Figure 8:
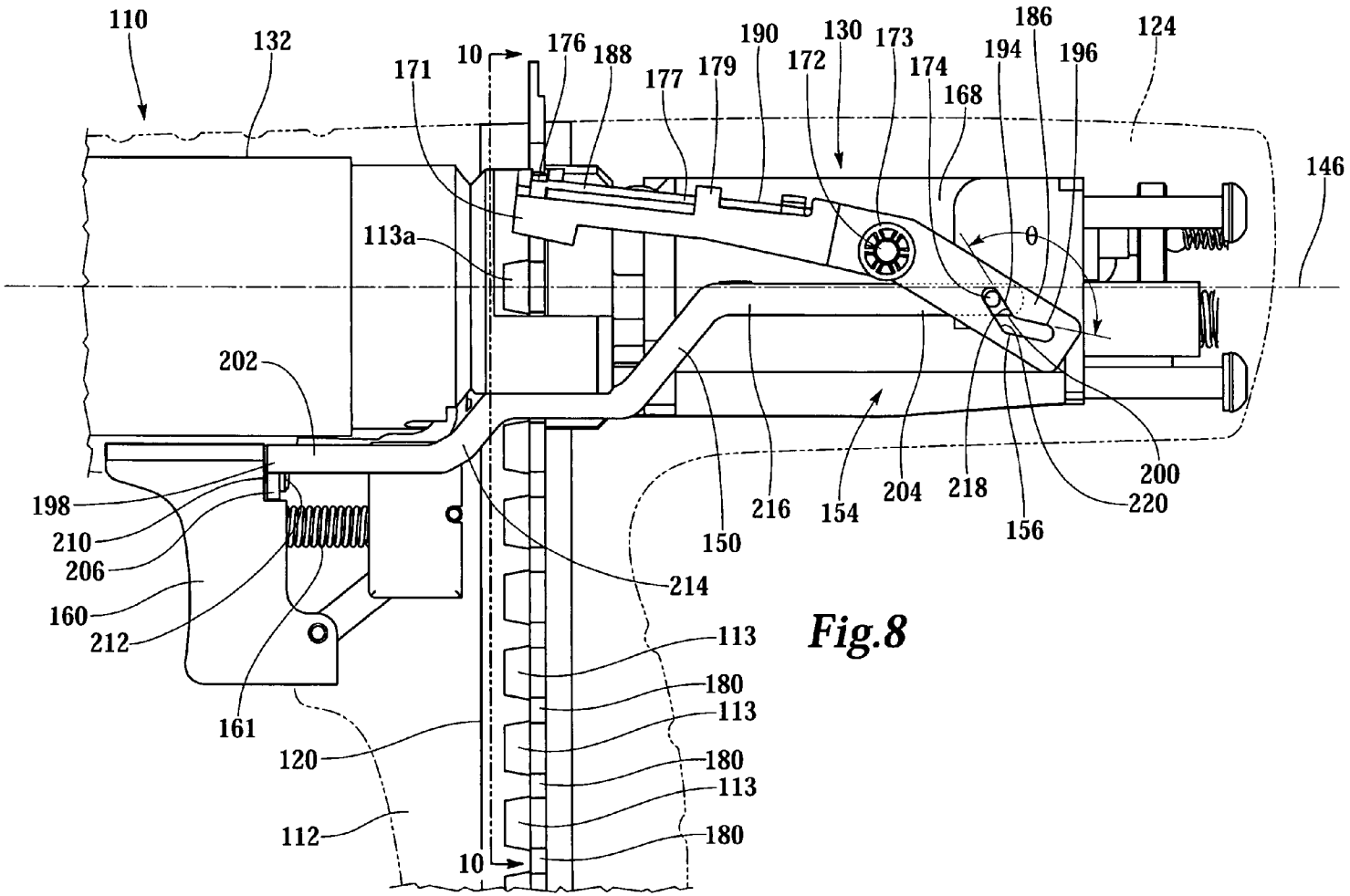
FIG. 8 is a partial side sectional view of the cartridge strip advancing mechanism in a first position.
Figure 9:
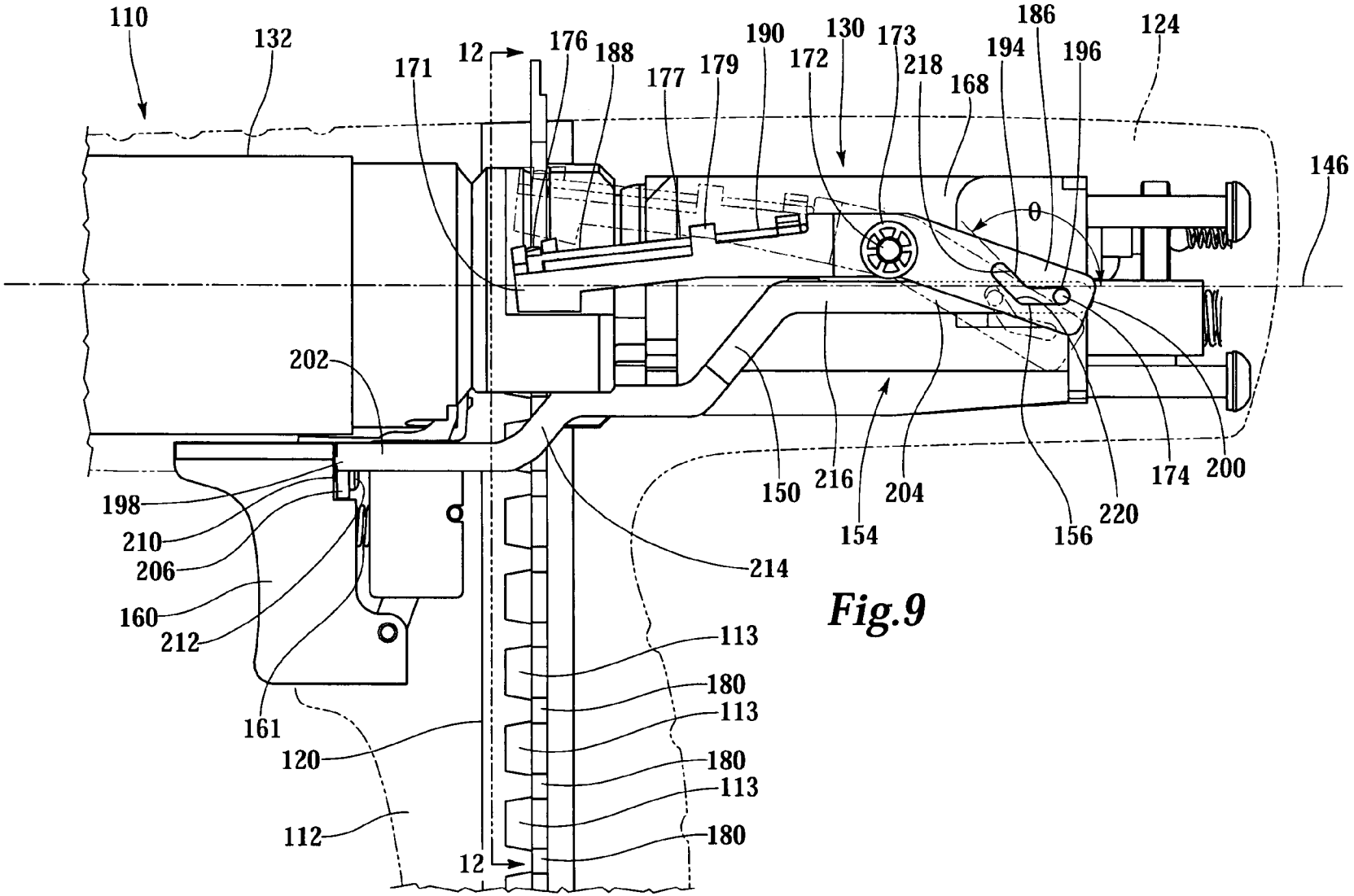
FIG. 9 is a partial side sectional view of the cartridge strip advancing mechanism in a second position.
Figure 15:
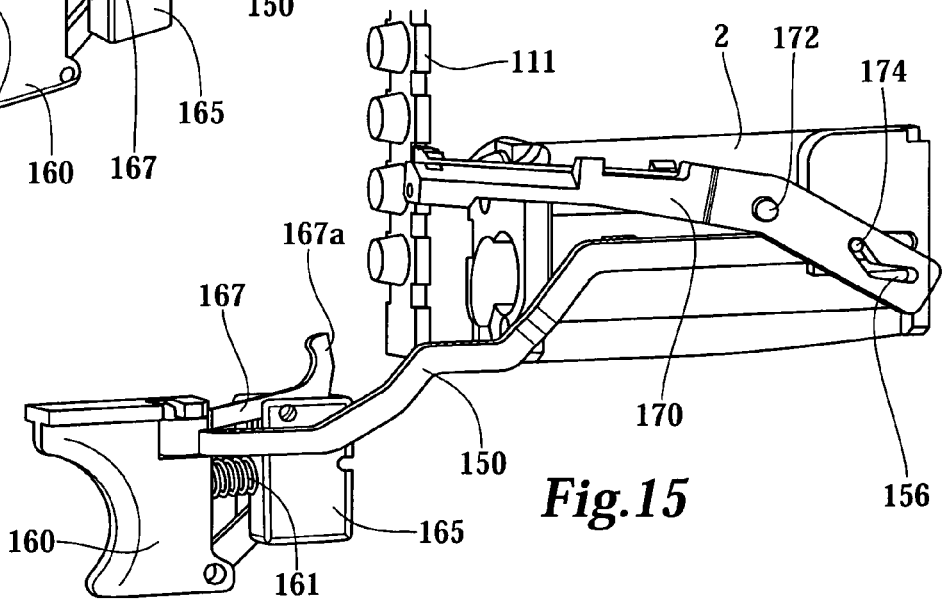
FIG. 15 is a perspective view of the advancing mechanism shown in an uncocked state of the tool.

Trigger 160 is connected to handle 112 so that trigger 160 can be pulled by an operator from a first pre-firing position, shown in FIG. 8, to a second fired position, shown in FIG. 9, actuating a firing mechanism 130 which fires a cartridge 113 placed within a firing chamber 134. Trigger 160 is biased into the first, pre-firing position by a trigger spring 161. In one embodiment, best seen in FIG. 15, trigger 160 is mounted for reciprocatory movement from a fixed trigger support 165 mounted to tool housing 122 against the bias of trigger spring 161, which is interposed between trigger 160 and trigger support 165

Figure 6:
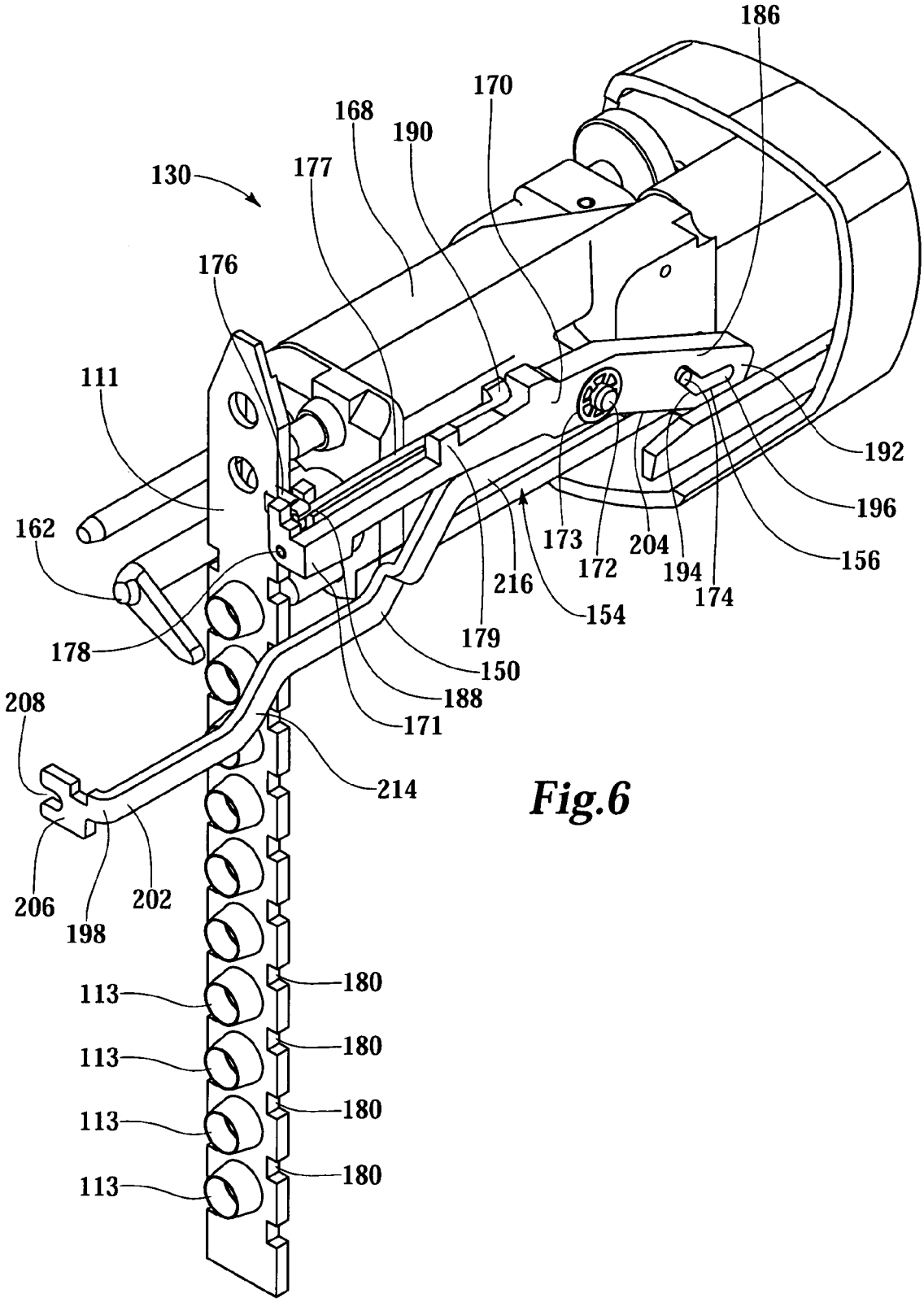
FIG. 6 is a perspective view of a firing mechanism and a cartridge strip advancing mechanism of the powder actuated tool.
Figure 16:
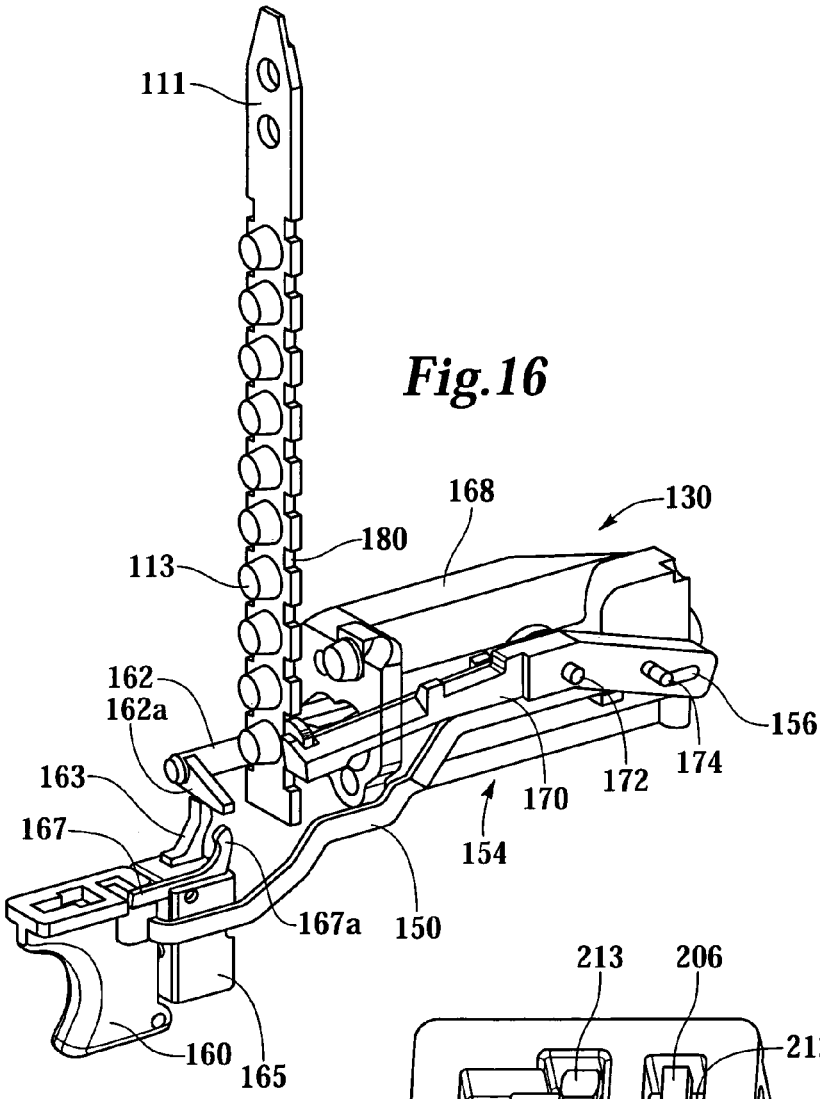
FIG. 16 is a perspective view of the advancing mechanism shown after an advancing lever has completed its movement during firing of the tool.

Turning to FIGS. 6 and 7, firing mechanism 130 includes cocking rod 162, a firing pin 164 and a firing spring 166 to bias firing pin 164 toward cartridge 113. Cocking rod 162 is adjacent to barrel 132 and is pushed in the trailing direction when tool 110 is cocked as barrel 132 is pushed in the trailing direction by muzzle 118, as described above. Cocking rod 162 includes a rotary seer (not shown) which engages firing pin 164 in the trailing direction so that firing spring 166 is compressed, as shown in FIG. 7. When trigger 160 is pulled by the operator, cocking rod 162 is rotated so that the rotary seer is rotated out of the way of firing pin 164 so that the rotary seer is no longer engaging firing pin 164. When the rotary seer is no longer engaging firing pin 164, firing spring 166 is free to extend and bias firing pin in the driving direction so that firing pin 164 can detonate cartridge 113. In the cocked condition, shown in FIG. 16, an arm **162*a* at the forward end of cocking rod 162 has moved into alignment with a link 163 mounted in a trigger support 165. When trigger 160 is depressed, link 163 is displaced upwardly to engage arm 162*a* and thereby rotate cocking rod 162 in order to release the rotary seer from engagement with firing pin 164. The firing pin 164 is then released to be driven forwards to detonate the cartridge 113 in firing chamber 134 of barrel 132**.

Continuing with FIG. 7, an exemplary cartridge strip 111 contains a plurality of explosive cartridges 113 arranged in a row. Each cartridge 113 of cartridge strip 111 contains a predetermined amount of explosive powder which is detonated by firing pin 164 during firing of tool 110. A cartridge 113 can only be detonated once by firing pin 164, because once the explosive powder has been detonated, it is used up and must be replaced by a second cartridge 113*b*. Cartridge strip 111 allows a plurality of cartridges 113 to be fed to tool 110, so that an operator may fire tool 110 several times without having to reload explosive powder cartridges 113. Cartridge strip 111 is indexed by an advancing mechanism 154 through a cartridge strip channel 120. Cartridge strip channel 120 extends in the indexing direction through handle 112 and housing so that cartridges 113 can be indexed into and out of firing chamber 134.

Trigger 160 is also associated with advancing mechanism 154 for automatically indexing cartridge strip 111. Advancing mechanism 154 is operationally associated with trigger 160 so that when trigger 160 is in its first pre-firing position, advancing mechanism 154 is in a first position, as shown in FIG. 8, and when trigger 160 is pulled by an operator into a second fired position, advancing mechanism 154 is moved into a second position, as shown in FIG. 9.

Turning to FIGS. 8 and 9, advancing mechanism 154 includes an advancing lever 170 and an advance link 150. Advance link 150 is operationally associated with trigger 160 so that when trigger 160 is in a first pre-firing position, shown in FIG. 8, advance link 150 is in a first position, and when trigger 160 is pulled by an operator into a second fired position, shown in FIG. 9, advance link 150 is biased into a second position. Advancing lever 170 indexes cartridge strip 111 in the indexing direction and is cammingly engaged with advance link 150, as described below, so that when advance link 150 is in a first position, advancing lever 170 is also in a first position, and when advance link 150 is biased into a second position, advancing lever 170 is pivoted into a second position, as described below.

Advancing lever 170 is pivotally connected to tool 110 by a pivot pin 172 so that advancing lever 170 can pivot between a first position, shown in FIG. 8, and a second position, shown in FIG. 9. In one embodiment, shown in FIG. 6, pivot pin 172 is connected to a firing mechanism housing 168 so that advancing lever 170 is pivotally connected to mechanism housing 168. However, advancing lever 170 can be pivotally connected to tool housing 122 without varying from the broad scope of the present invention. A retaining clip 173 is connected to pivot pin 172 in order to prevent advancing lever 170 from becoming disengaged with pivot pin 172 during operation of tool 110.

Continuing with FIG. 8, advancing lever 170 includes a strip engagement portion 171 for engaging and indexing cartridge strip 111, a pivot hole for receiving pivot pin 172, and a lever camming portion 186 for cammingly engaging with advance link 150, described below. A retention clip 173 is also included to ensure that advancing lever 170 remains pivotally connected, via pivot pin 172, to tool 110 during operation of tool 110.

In a preferred embodiment, strip engagement portion 171 is located generally at a driving end of advancing lever 170, pivot pin 172 is generally centered along advancing lever 170 and lever camming portion 186 is located generally at a trailing end of advancing lever 170, wherein strip engagement portion 171 and lever camming portion 186 are on opposite sides of the pivot hole. However, advancing lever 170 is not limited to this configuration. An alternative embodiment (not shown) includes the pivot hole located generally at the trailing end and the camming portion generally centered along the advancing lever. The alternative advancing mechanism can still operate to index cartridge strip 111, as described below.

Turning to FIG. 6, one embodiment of strip engagement portion 171 of advancing lever 170 is shown. Strip engagement portion 171 includes a pawl 176 connected to advancing lever 170 and a spring 177 for biasing pawl 176 toward cartridge strip 111. Pawl 176 is pivotally connected to advancing lever 170 with a pin 178 so that pawl 176 can pivot in and out of notches 180 in cartridge strip 111 in a ratcheting motion, described below. In one embodiment, spring 177 is a flexible rod which has a first end 188 retained by advancing lever 170 and a second end 190 engaged with pawl 176, wherein a boss 179 connected to advancing lever 170 bends spring 177 between first end 188 and second end 190 so that spring 177 provides a biasing force against pawl 176 to bias pawl into a notch 180 of cartridge strip 111. When advancing lever 170 is in its first position, strip engagement portion 171 is in an upper first position, shown in FIG. 8, and when advancing lever 170 pivots to its second position, strip engagement portion 171 moves to a lower second position, shown in FIG. 9.

Figure 14:
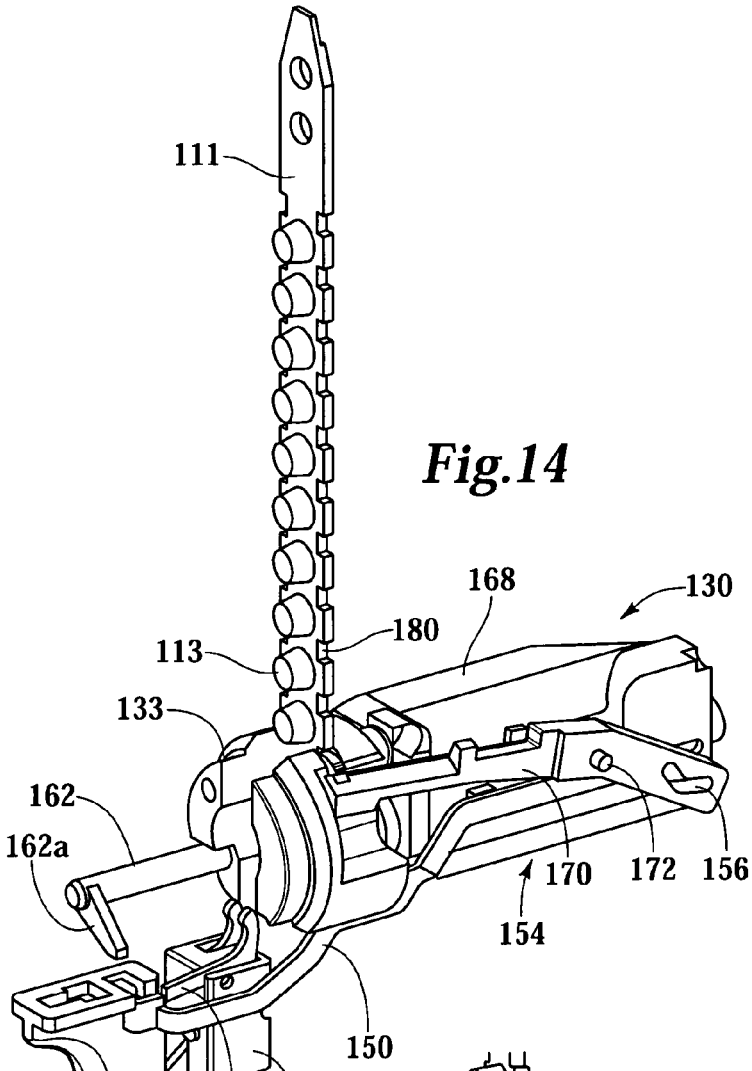
FIG. 14 is a perspective view of the advancing mechanism shown with a breach block.

It will be understood that during the movement of advancing lever 170 and pawl 176 which occurs during firing of tool 110, cartridge strip 111 is fixed in position as the operative cartridge 113 is held within firing chamber, 134 at the rear of barrel 132 with the breach block 133, shown in FIG. 14, being closed. After firing, the breach is opened by forwards movement of barrel 132 and breach block 133 to release the spent cartridge 114. The trigger 160 is also released and moves forwardly under the bias of trigger spring 161. This forwards movement is translated into movement of the advance link 150 and, via cam pin 174, and cam slot 156, there results an upwards movement of the forward end of the advancing lever 170; due to the engagement of the pawl 176 with the adjacent notch 180 of the cartridge strip 111, the cartridge strip 8 itself will also be indexed to present the next cartridge 113 at the operative firing position.

The spring 177 which biases pawl 176 and which is deflected during the advancing movement of the advancing lever 170 will result in an increased trigger force and this can also be readily controlled to ensure reliability of the action of pawl 176 without unduly increasing the trigger force needed to be applied to fire the tool. This spring biasing enables the spring force applied to pawl 176 to be adjusted simply by selection of spring wire of appropriate characteristics.

Returning to FIG. 6, one embodiment of lever camming portion 186 includes a ramped cam slot 156, which corresponds to a cam pin 174 on advance link 150. However, in an equivalent alternative embodiment (not shown) the cam pin is located on the advancing lever and the cam slot is in the advance link. Cam slot 156 extends generally along advancing lever 170 and is located generally at a trailing end 192 of advancing lever 170. Cam slot 156 includes a ramped leading leg 194 and a trailing leg 196 aligned essentially parallel to advancing lever 170, wherein cam slot 156 is oriented so that it is generally convex in the indexing direction, with an angle θ, shown in FIG. 8, between leading leg 194 and trailing leg 196. In one embodiment, angle θ is between about 110° and about 150°, and preferably about 135°.

The length of leading leg 194 and trailing leg 196 are generally equal to each other, with each leg 194,196 having a length between about 0.220 inches and about 0.240 inches, with a preferred length of leading leg 194 being about 0.115 inches and a preferred length of trailing leg being about 0.115 inches. The width of cam slot 156 should be slightly larger than the diameter of cam pin 174 so that cam pin 174 fits within cam slot 156 within a close, predetermined tolerance. In one embodiment, cam pin 174 has a diameter of about 0.098 inches, and cam slot 156 has a width of about 0.104 inches.

It is necessary to "tune" the mechanism so that the trigger action provides a comfortable feel. To an extent this can be accomplished by appropriate shaping of the cam slot 156, which can be determined empirically. The cam slot 156 provides a degree of lost motion towards the end of the depression stroke of the trigger 160 whereby the indexing movement of the advancing lever 170 occurs during the initial and intermediate parts of the movement of the trigger 160.

Cam slot 156, and particularly trailing leg 196, should have a length sufficient to allow cam pin 174 to continue to slide along trailing leg 196 even after advancing lever 170 has pivoted from the first position to the second position so that strip engagement portion 171 is engaged with a lower second notch 180*b* in cartridge strip 111. When cam pin 174 is allowed to continue to slide, it prevents "dead stop" of the trigger so that an operator does not feel a hard stop of trigger 160 when strip engagement portion 171 engages with a notch 180 in cartridge strip 111, as described below, but rather can continue to pull trigger 160 in the trailing direction for a time after advancing mechanism 154 has moved from its first position to its second position.

Turning to FIG. 8, advance link 150 is operationally associated with trigger 160 so that when trigger 160 moves in the trailing direction from its first pre-firing position to its second fired position when an operator pulls the trigger 160, advance link 150 also moves from a first position to a second position. Advance link 150 includes a trigger engagement portion 198 for engaging with trigger 160, and a link cam portion 200 for cammingly engaging with advancing lever 170. In one embodiment, trigger engagement portion 198 is located generally at a driving end 202 of advance link 150, and link cam portion 200 is located generally at a trailing end 204 of advance link 150.

In one embodiment, shown in FIG. 6, trigger engagement portion 198 includes a flange 206 having a slot 208. Advance link 150 is connected to a trailing end 210 of trigger 160 with a screw 212, shown in FIG. 8, that extends through slot 208 and into trigger trailing end 210, wherein screw 212 is tightened so that flange 206 is tightly flush against trigger 160.

Figure 17A:
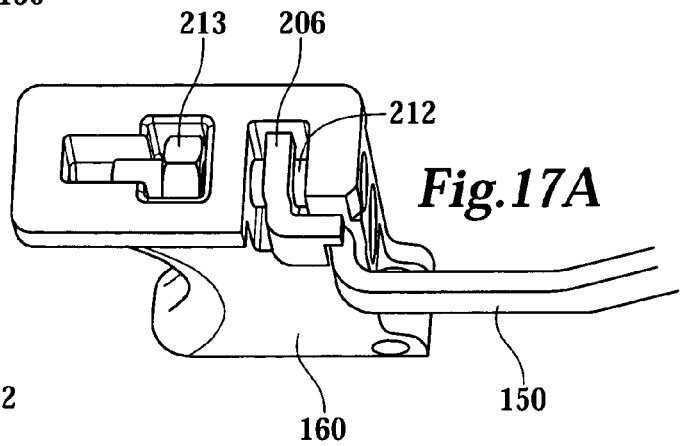
FIGS. 17A and 17B are perspective views showing an adjustable connection between the trigger and an advance link of the advancing mechanism in order to provide fine tuning.
Figure 17B:
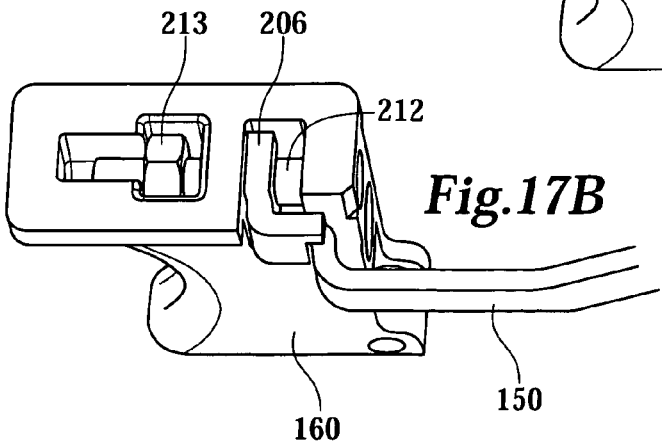

As part of the tuning of the indexing system, it is necessary to ensure that the movement of the advancing lever 170 during trigger depression moves the pawl 176 into the next notch 180 of cartridge strip 111 only when trigger 160 has been depressed sufficiently to fire the cartridge 113, so as to avoid a mis-indexing situation which could otherwise arise if the trigger 160 is only partially depressed. While to an extent this is also determined by the shaping of the cam slot 156, however manufacturing tolerances can adversely influence the required timing between trigger depression and indexing movement of lever 170. In order to account for tolerances which can also arise during manufacture, the forward end of link 150 is connected to trigger 160 by a screw threaded adjustable mounting which can adjust the relative point of attachment of the forward end of link 150 in a fore-aft direction relative to trigger 160. This adjustable mounting is shown in greater detail in FIGS. 17A and 17B and comprises a set screw 212 mounted within trigger 160. Set screw 212 is rotatable to effect fore-aft adjustment of the mounting position of flange 206 of link 150 as can be seen from a compression between FIGS. 17A and 17B and is lockable in the set position by means of a lock nut 213. As a result of this adjustment facility, at the time of assembly of the tool link 150 can be adjusted to ensure that the full indexing movement of lever 170 can only take place when trigger 160 has been depressed sufficiently to fire the tool.

Advance link 150 is guided by a guide (not shown) in tool 110 so that advance link 150 remains generally parallel to axis 146 when advance link 150 is moved from its first position to its second position. In one embodiment, shown in FIGS. 5 and 8, advance link 150 includes a bent leading portion 214 and a straight trailing portion 216. Bent leading portion 214 is adjacent to flange 206 in the trailing direction. The shape of bent leading portion 214 is chosen to allow advance link 150 to fit in the tight space within tool housing 122 so that advancing mechanism 154 can operate in a small space. Straight trailing portion 216 remains generally parallel to axis 146 due to the guide.

Returning to FIG. 8, in one embodiment, link cam portion 200 includes a cam pin 174 located generally at trailing end 204 of advance link 150 and extending outwardly away from an outer surface 216 of advance link 150. An alternative embodiment (not shown) includes cam pin 174 extending inwardly from an inner surface of advance link 150. In another alternative (not shown), as described above, link cam portion 200 could instead include a cam slot that corresponds to a cam pin located on advancing lever 170.

As described above, advance link 150 moves generally parallel to axis 146 so that cam pin 174 essentially moves in a straight line in the trailing direction when advance link 150 is biased from its first position to its second position by trigger 160. Cam pin 174 slides along cam slot 156, as described below, to cause advancing lever 170 to pivot about pivot pin 172.

Continuing with FIG. 8, advancing mechanism 154 is designed so that an operator does not have to manually perform any set of tasks to index cartridge strip 111. Pulling trigger 160 actuates firing mechanism 130, as described above, as trigger 160 is moved from its first pre-firing position to its second fired position. Advancing mechanism 154 provides a link between trigger 160 and strip engagement portion 171 so that indexing of cartridge strip 111 is automatically performed by the movement of trigger 160.

Continuing with FIG. 8, when trigger 160 is in the first position before an operator pulls trigger 160, advance link 150 is located in the first position wherein advance link 150 is in its most forward position in the driving direction. When advance link is in the first position, cam pin 174 is generally at the driving end of leading leg 194 of cam slot 156 so that advancing lever 170 is in its first position with strip engagement portion 171 in its upward position.

When trigger 160 is pulled by an operator, advance link 150 is biased from the first position, shown in FIG. 8, in the trailing direction to the second position, shown in FIG. 9. Advance link 150 remains aligned essentially parallel to axis 146 so that cam pin 174 is biased essentially strait in the trailing direction. As cam pin 174 moves in the trailing direction, cam pin 174 comes into contact with and slides along an upper surface 218 of leading leg 194 of cam slot 156. As cam pin 174 continues to move in the trailing direction, the ramped orientation of leading leg 194 of cam slot 156 forces the trailing end 192 of advancing lever 170 to pivot upwards, so that the entire advancing lever 170 pivots in a counterclockwise direction in FIG. 9. This rotation causes strip engagement portion 171 to be pivoted downward so that strip engagement portion 171 disengages from a first notch 180*a* in cartridge strip 111, and engages with a lower second notch 180*b*, shown in FIGS. 10–12.

Figures 10, 11, 12, 13:
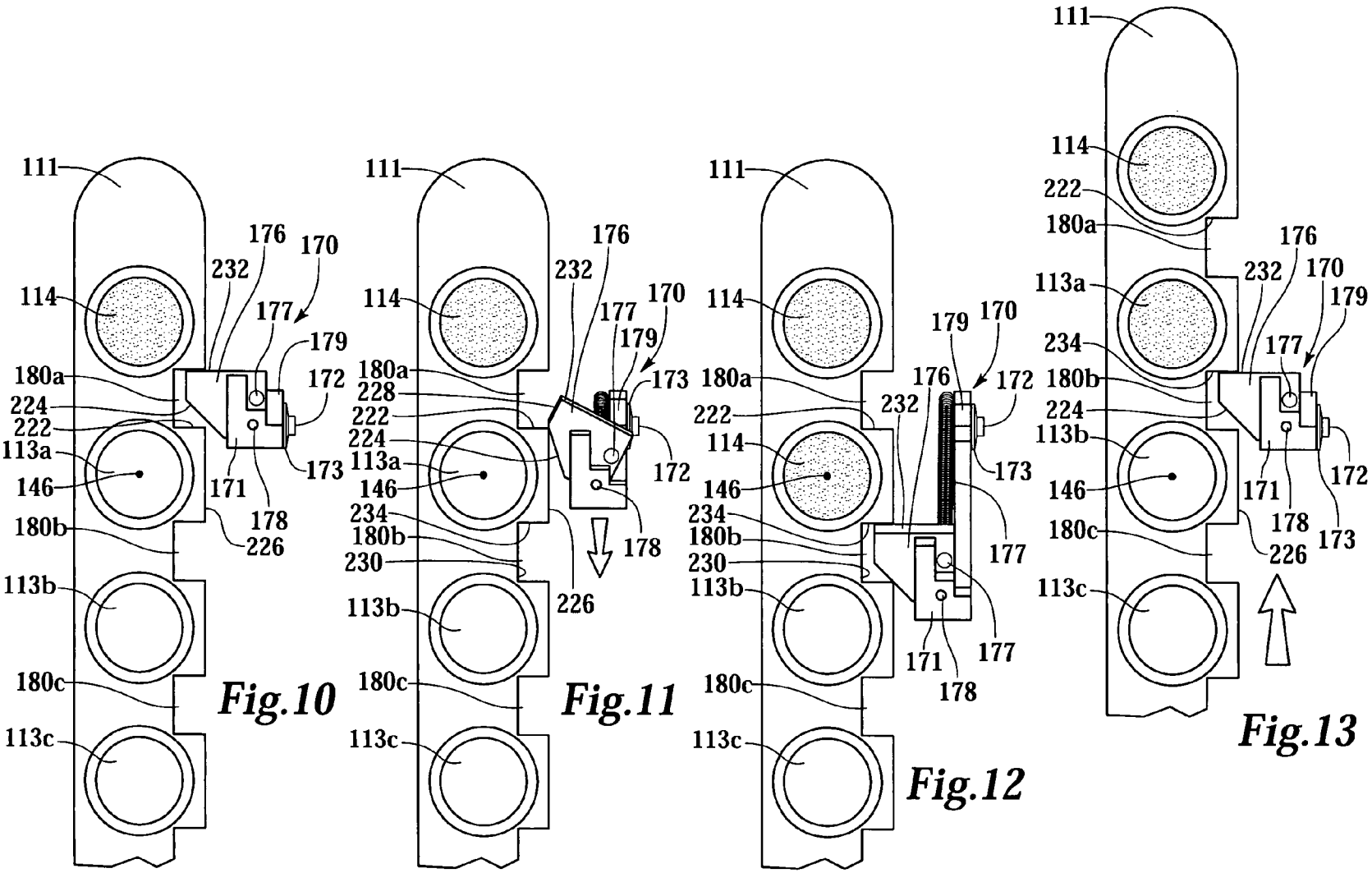
FIG. 10 is a sectional view of the cartridge strip advancing mechanism taken along line 10—10 in FIG. 8, wherein the advancing mechanism is in the first position.
FIG. 11 is a sectional view of the cartridge strip advancing mechanism wherein the advancing mechanism is moving from the first position to the second position.
FIG. 12 is a sectional view of the cartridge strip advancing mechanism taken along line 12—12 in FIG. 9, wherein the advancing mechanism in is the second position.
FIG. 13 is a sectional view of the cartridge strip advancing mechanism in the first position, wherein the advancing mechanism has indexed a cartridge strip from the second position to the first position.

As shown in FIG. 10, when strip engagement portion 171 is in the first upward position, pawl 176 is engaged within an upper first notch 180*a* so that an upper first cartridge 113*a* is aligned with axis 146 so that first cartridge 113*a* is within a firing chamber 134 (shown in FIG. 7). When trigger 160 is pulled by an operator, first cartridge 113*a* is detonated by firing mechanism 130 so that cartridge 113*a* becomes a spent cartridge 114 shown in FIG. 11. At the same time trigger biases advance link 150 in the trailing direction, and advancing lever 170 is rotated from the first position to the second position, as shown in FIG. 9 and described below.

When advancing lever 170 is rotated, strip engagement portion 171 is rotated from its upward first position, shown in FIG. 10, to its downward second position, shown in FIG. 12. When strip engagement portion 171 begins to be biased downward, a bottom surface 222 of first notch 180*a* pushes against a sloped bottom surface 224 of pawl 176, urging pawl 176 against the bias of spring 177, and causing pawl 176 to pivot out of first notch 180*a* on pin 178, as shown in FIG. 11. As strip engagement portion 171 continues to be biased downward from the first position to the second position, pawl 176 slides along side surface 226 of cartridge strip 111.

Turning to FIG. 12, eventually strip engagement portion 171 is biased to its downward second position, so that pawl 176 encounters a lower second notch 180*b*, wherein second notch 180*b* is located directly below first notch 180*a* on cartridge strip 111. Second notch 180*b* corresponds to a second cartridge 113*b* located directly below first cartridge 113*a*. Spring 177 biases pawl 176 into second notch 180*b* so that a side surface 228 of pawl 176 is biased against side surface 230 of second notch 180*b*.

When trigger 160 is released, trigger spring 161 biases trigger 160 from its second position in the driving direction back towards the pre-firing first position. Advance link 150 is associated with trigger 160 so that advance link 150 is also biased from the second position in the driving direction to the first position. As cam pin 174 is moved along with advance link 150 in the driving direction, cam pin 174 slides first along trailing leg 196, and then up sloped leading leg 194 where cam pin 174 contacts a bottom surface 220 of leading leg 194, pushing trailing end 192 of advancing lever 170 downward and pivoting advancing lever 170 from the second position to the first position, or in a clockwise direction in FIG. 8.

As advancing lever 170 pivots from the second position in FIG. 12 to the first position in FIG. 13, strip engagement portion 171 moves upwardly, causing a top surface 232 of pawl 176 to contact an upper surface 234 of second notch 180*b*. As strip engagement portion 171 continues to move upward, top surface 232 of pawl 176 engages upper surface 234 of second notch 180*b* so that pawl 176 biases cartridge strip 111 upwardly, indexing the spent first cartridge 113*a* out of firing chamber 134 and indexing second cartridge 113*b* into firing chamber 134 so that tool 110 is ready to fire again.

The operator can now pull trigger 160 again, causing firing mechanism 130 to detonate second cartridge 113*b* and causing advancing mechanism 154 to move strip engagement portion 171 from its upward position, with pawl 176 engaged within second notch 180*b*, to its downward position, with pawl 176 engaged within a third notch 180*c*. The operator can then release trigger 160, allowing advancing mechanism 154 to return strip engagement portion 171 to its first position so that pawl 176 can engage third notch 180*c* and index a third cartridge 113*c* into firing chamber 134. This process may be repeated several times until cartridge strip 111 runs out of cartridges 113 that may still be fired.

It is important that the trigger is unable to be depressed until the tool is ready to be fired as depression of the trigger will result in movement of advancing mechanism 154, resulting in mis-indexing of strip 111. For this reason, trigger support 165 can carry a trigger lock lever 167 which normally engages a rear abutment edge of trigger 160 (see FIG. 15) to prevent its depression. Trigger lock lever 167 includes an upwardly extending release arm 167*a* which is engaged by a projection at the rear of barrel 132 on cocking of tool 110 to pivot trigger lock lever 167 out of its locking position (see FIG. 5) and thereby permit depression of trigger 160 which results in firing of tool 110 and also the described downward indexing movement of indexing lever 170 and associated pawl 176. An example of a trigger lock is disclosed in Australian Provisional Application 2002951660, filed Sep. 25, 2002 in the Australian Patent Office, the disclosure of which is incorporated herein by reference.

The inventive fastener driving tool of the present invention provides an improved advancing mechanism for the indexing of a strip of explosive powder cartridges through a cartridge strip channel. The advancing mechanism provides automatic indexing of the cartridge strip caused by the motion of the trigger used to fire the tool so that once a cartridge is used, a fresh cartridge is moved into place so that the tool is automatically ready to fire without requiring an operator to manually advance the cartridge strip, or to manually perform tasks that advance the cartridge strip. The advancing-mechanism also prevents "dead stop" of the trigger, helping to improve operator comfort due to the repetitive task of pulling the trigger.

The present invention is not limited to the above-described embodiments, but should be limited solely by the following claims.

What is claimed is:

1. A powder driven fastening tool comprising:

a channel for feeding a strip of cartridges to a firing mechanism;

a trigger for actuating the firing mechanism, the trigger being movable between a first, pre-firing position and a second firing position;

an advance link operatively coupled with the trigger;

an elongated advancing lever, having one end portion cammingly engaged with the advancing link, an opposite end portion having a strip engagement portion extending into the channel for indexing the strip, and being pivotally coupled to the tool between said end portions;

the strip engagement portion being in a first position in the channel when the trigger is in the first position; and the strip engagement portion being movable between said first position and a second position for advancing said strip in the channel when the trigger is moved from said first, pre-firing position to the second, firing position.

2. A powder driven fastening tool according to claim 1, wherein the advance link further comprises a cam pin and the advancing lever further comprises a ramped cam slot, whereby the advancing lever pivots as the cam pin of the advance link follows the ramped cam slot of the advancing lever.

3. A powder driven fastening tool according to claim 2, wherein the cam pin is located at a first position along the cam slot when the trigger is in the first position, and wherein the cam pin is located at a second position along the cam slot when the trigger is in the second position.

4. A powder driven fastening tool according to claim 1, wherein the advancing lever is pivotally coupled to the tool by a pivot pin, whereby the strip engagement portion is disposed on one side of the pivot pin and the advancing lever is cammingly engaged with the advance link on another side of the pivot pin.

5. A powder driven fastening tool according to claim 4, wherein the pivot pin is connected to a housing of the firing mechanism.

6. A powder driven fastening tool according to claim 1, further comprising a firing chamber positioned along the channel between a barrel of the tool and the firing mechanism, the strip engagement portion being positioned toward the firing chamber when the strip engagement portion is in the first position, the strip engagement portion being positioned away from the firing chamber when the strip engagement portion is in the second position.

7. A powder driven fastening tool according to claim 1, further comprising a spring disposed between the trigger and a trigger support of the tool, wherein the spring biases the trigger to the first position, whereby the trigger is movable to the second position against the bias of the spring.

8. A powder driven fastening tool according to claim 1, wherein the cartridge strip has a series of notches, and wherein the strip engagement portion includes a pawl for engaging with a notch of the cartridge strip.

9. A powder driven fastening tool according to claim 8, wherein the pawl is engaged with a first notch of the cartridge strip when the strip engagement portion is in the first position, and wherein the pawl is engaged with a second notch of the cartridge strip when the strip engagement portion is in the second position.

10. A powder driven fastening tool according to claim 9, wherein movement of said trigger into said second position of said trigger moves said pawl into engagement with said second notch of said cartridge strip when said trigger has been depressed sufficiently to fire said tool.

11. A powder driven fastening tool according to claim 8, wherein the advancing lever further comprises a spring for biasing the pawl into engagement with the notch, wherein the pawl is movable into disengagement out of the notch against the bias of the spring.

12. A powder driven fastening tool according to claim 11, wherein said spring is deflected during said disengagement of said pawl out of said notch, and wherein trigger force can be controlled.

13. A powder driven fastening tool according to claim 1, further comprising a trigger lock preventing depression of said trigger until said tool is cocked.

14. A powder driven fastening tool according to claim 1, further comprising an adjustable connection between said trigger and said advance link.

* * * * *